US006644843B2

(12) United States Patent
Chin-Cheng

(10) Patent No.: US 6,644,843 B2
(45) Date of Patent: Nov. 11, 2003

(54) INFLATABLE FIGURE ASSEMBLY

(76) Inventor: Tsai Chin-Cheng, No. 13, Junghua Road, Linluo Shiang Pingtung (TW), 909

( * ) Notice: Subject to any disclaimer, the term of this patent is extended or adjusted under 35 U.S.C. 154(b) by 0 days.

(21) Appl. No.: 10/042,622

(22) Filed: Jan. 9, 2002

(65) Prior Publication Data

US 2003/0128553 A1 Jul. 10, 2003

(51) Int. Cl.[7] ..... F21S 4/00

(52) U.S. Cl. ..... 362/808; 362/806; 362/249; 362/96; 446/226

(58) Field of Search ..... 362/806, 808, 362/186, 352, 249, 96; 446/219, 220, 226

(56) References Cited

U.S. PATENT DOCUMENTS 4,179,832 A * 12/1979 Lemelson ..... 40/540
5,710,543 A * 1/1998 Moore ..... 340/691.7
6,186,857 B1 * 2/2001 Gazit et al. ..... 446/226
6,322,230 B1 * 11/2001 Medici ..... 362/96
6,431,729 B1 * 8/2002 Chen ..... 362/249

* cited by examiner

*Primary Examiner*—Sandra O'Shea
*Assistant Examiner*—Ali Alavi

(57) ABSTRACT

A displayable inflatable figure has a main hollow body that is of a soft and air-permeable fabric. An extended part at the bottom includes a fan assembly to force air flow into the main body. An internally attached lighting system is fastened to provide illumination without external lighting. When connected with power, the fan continuously pumps air into the body. When air is filled in the body, excessive air leaks out from the fabric so that the figure can keep a good shape.

10 Claims, 4 Drawing Sheets

INFLATABLE FIGURE ASSEMBLY

BACKGROUND OF THE INVENTION

This invention relates generally to air-filled displays and more particularly to an inflatable figure assembly.

The prevailing displayable, inflatable figures use impermeable material such as plastic for the main body. Though this kind of material can be impermeable in a short time period, only a few polyester materials can prevent air from leaking out over a long time period, causing a display to look poor, as the display does not retain its shape. In addition, such air-filled figures are usable in lighted areas or during day light. At night, only with the help of external light, can people notice the existence of the figure.

SUMMARY OF THE INVENTION

An object of the invention is to provide an inflatable figure that persistently contains air inside of the body to retain an improved shape over a desired time period.

Another object of the present invention is to provide an inflatable figure that can be seen with little external light.

In accordance with a preferred embodiment of the present invention, the assembly figure has a hollow body made of soft, permeable fabric, a fan assembly forcing air into the main body, and a lighting system inside of the body. When the air has filled the body, the excessive air leaks out from the fabric, thus the figure can keep a good shape for a long time. In addition, the light inside of the body disperses to the outside, making it visible at nighttime.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
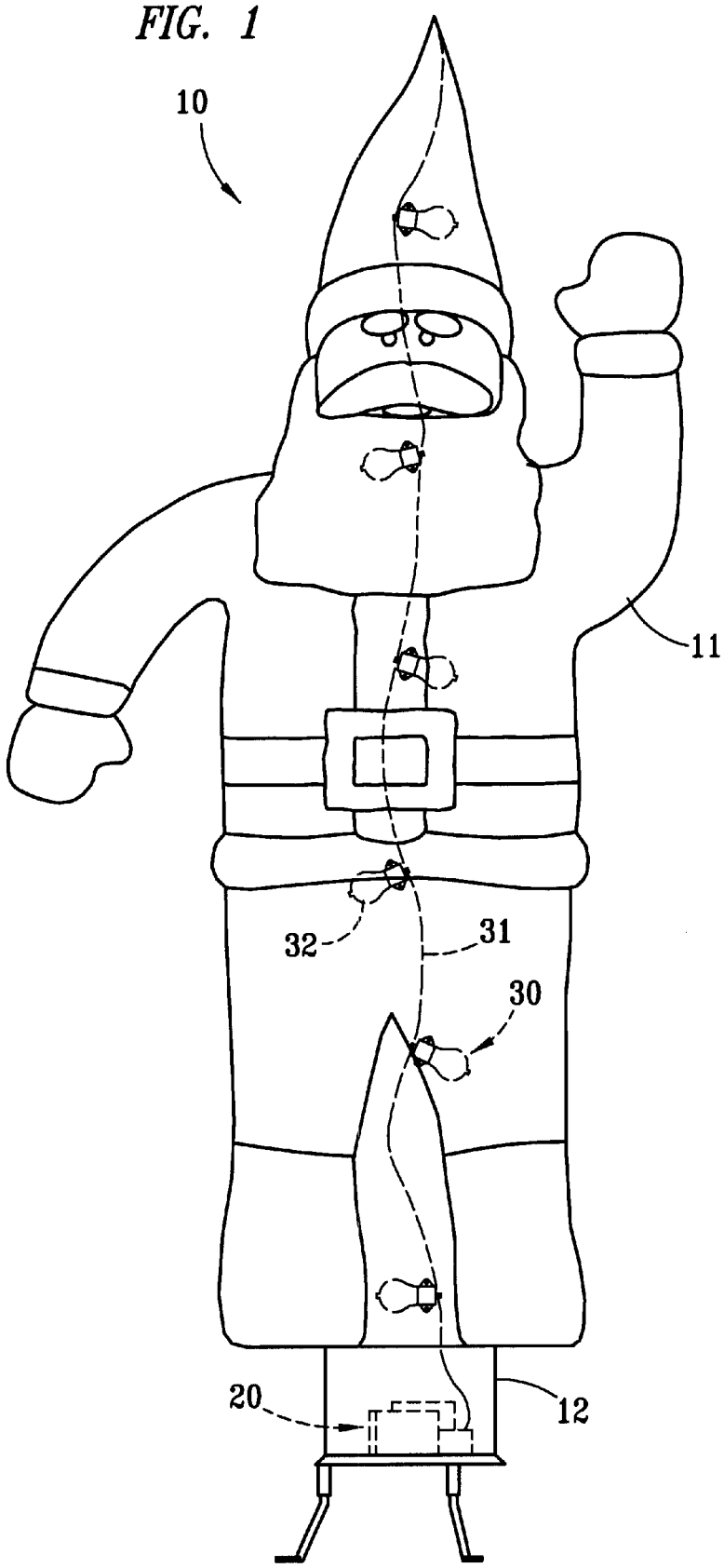
FIG. 1 is a perspective view of the inflatable figure assembly in accordance with a preferred embodiment of the present invention.

Referring to FIG. 1, inflatable FIG. 10 has hollow main body 11. Main body 11 is made of soft, permeable fabric such as nylon. Extended part 12 at the bottom of main body 11 includes assembly 20. There is also shown lighting system 30 inside of main body 11.

Figure 2:
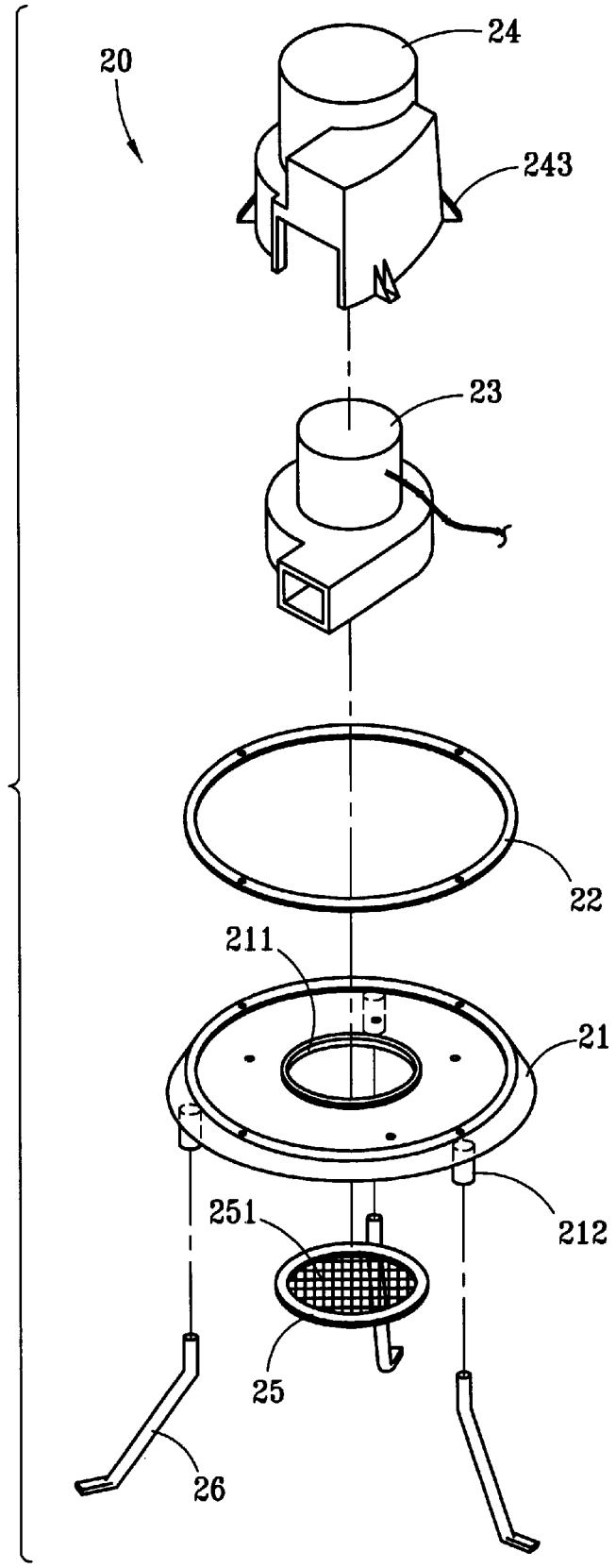
FIG. 2 is an exploded view of the fan and stand assembly in accordance with a preferred embodiment of the present invention.
Figure 3:
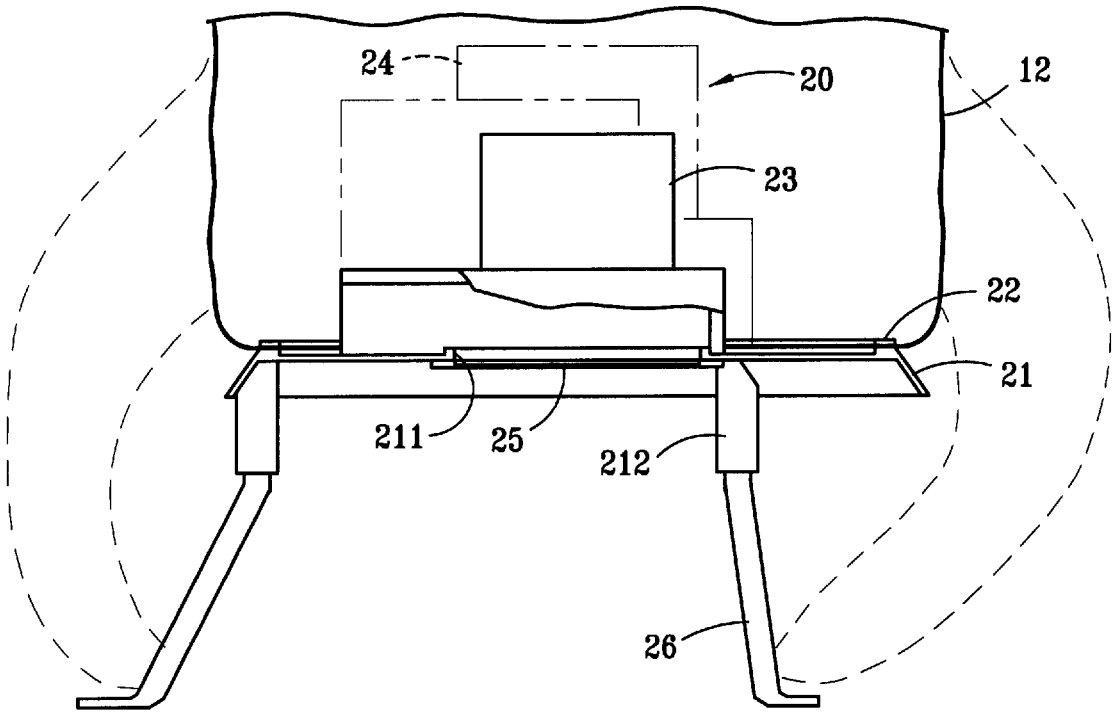
FIG. 3 is a side view of the fan and stand assembly of FIG. 2.

Referring to FIGS. 2 and 3, fan assembly 20 has base 21 and fastening ring 22 having a hole 211. Around base 21, there are several protruding fastening pieces 212 for detachably receiving supporting legs 26. In addition, base 21 and fastening ring 22 help tighten and hold extended part 12. At the bottom of hole 211 of base 21, air vent 25 has a plurality of parallel holes 251 along the edge. Motor 23 is installed on top of base 21, within cover 24. Fastening piece 243 on cover 24 helps to fasten motor 23 on base 21. The motor will continue to force air into the figure when on. Once filled, the permeability of the main body material allows air to escape, while still maintaining the figure shape.

Figure 4:
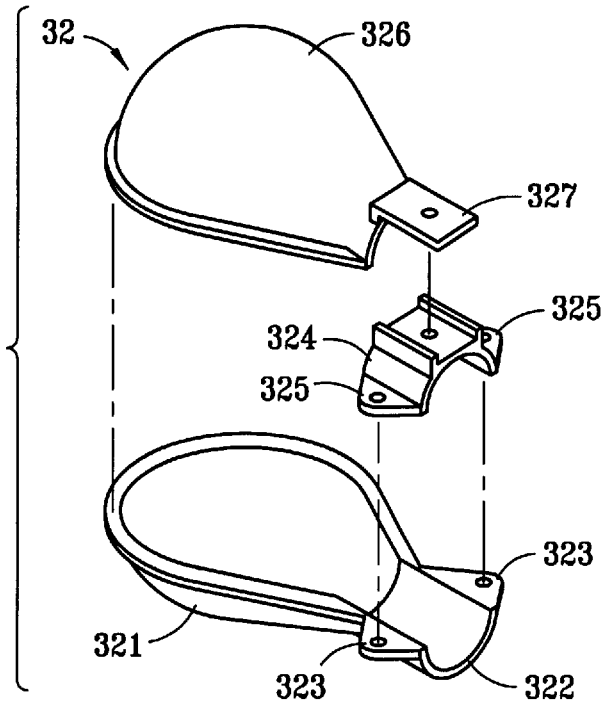
FIG. 4 is an exploded view of a section of the lighting assembly in accordance with a preferred embodiment of the present invention.

Turning to FIGS. 1 and 4, lighting system 31 includes a power cord, on which there are several bulbs, or lighting bodies, 32. Lighting body 32 includes lower part 321 and upper cover 326. Connecting base 322 on lower cover 321 enables the bulbs 32 on power cords 31 to be inserted into the lower cover 321. Fastening base 324 sets on top of connecting base 322, and two fastening pieces 323, 325 use screws to fasten them together. Upper cover 326 corresponds to fastening base 324 on which connecting joint 327 can be set so that the upper and lower cover of the lighting body can cover bulb 32 inside. The lights may be strung together as shown or extended at appropriate places within the body of the figure. When powered, the lights will illuminate the figure from within.

Figure 5:
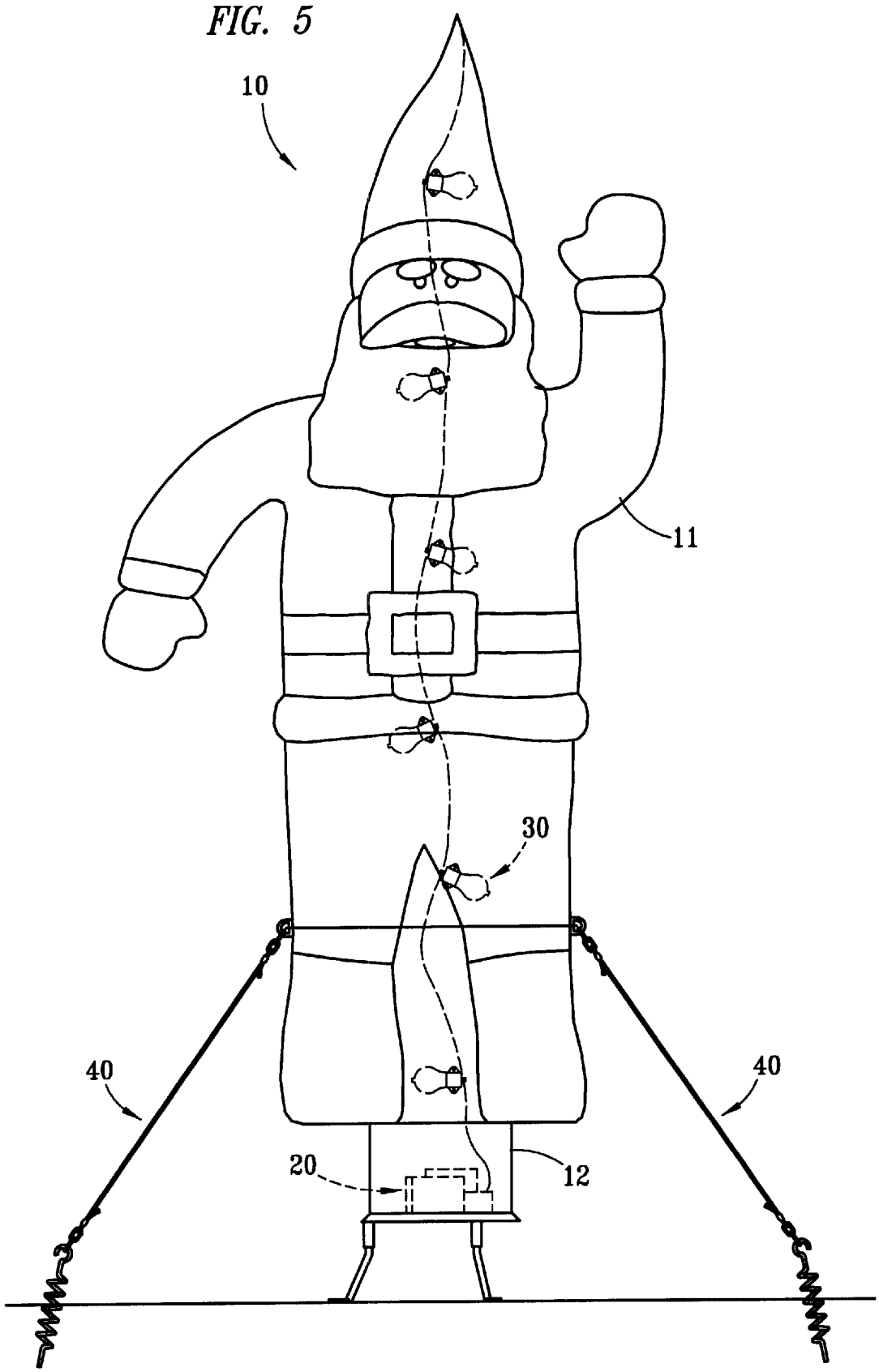
FIG. 5 is a perspective view of the inflatable figure assembly in its fully inflated and tied-down configuration.

Referring to FIG. 5, to set up, body 11 may use supporting legs 212 on fan equipment 20 to stand on the ground. There is a designed space between the ground and base 21 for air circulation for motor 230. If a higher position is needed, the supporting leg on the base could be extended. String may be fastened via loops of material to body 11 to tie down the body. Body 11 may also be designed with additional material towards the lower end that may be connected to the stand so as to cover the stand and fan assembly from view as shown in the dotted lines of FIG. 5.

Though shown here in only one configuration, the main body 11 may take on any of a variety of shapes and sizes. While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An inflatable figure assembly, comprising:

a hollow body made with permeable fabric forming a figure;

a base with a central hole;

a fastening member securing said hollow body to a circumference of said base;

a fan disposed over said central hole to discharge air into the hollow body;

at least three fastening protrusions around an edge of said body;

at least three legs, each secured in one of said fastening protrusions and supporting said base at a defined height above a surface to allow sufficient air to enter said fan;

a first power cord connected to said fan;

wherein said hollow body allows air to diffuse through it at a rate no faster than said fan discharges air into said hollow body;

a lighting system inside said hollow body, comprising a second power cord extending from a top of said inflatable figure assembly to said fan and a plurality of lighting bodies secured along said second power cord;

wherein each of said plurality of lighting bodies further comprises a lower cover with a base, an upper cover with a base, a bulb disposed between said upper and said lower cover and connected to said second power cord; and a fastening piece;

fasteners to secure said base of said lower cover, said base of said upper cover, and said fastening piece together.

2. The inflatable figure assembly of claim 1 further comprising tie-down loops secured to an exterior surface of said hollow body.

3. The inflatable figure assembly of claim 2 further comprising tethers fastened to said loops.

4. The inflatable figure assembly of claim 1 wherein said first power cord is connected to said second power cord.

5. The inflatable figure assembly of claim 1 wherein said base is circular.

6. The inflatable figure of claim 1 wherein said circumference of said base is along said edge of said base.

7. The inflatable figure assembly of claim 1 further comprising a cover disposed over said fan.

8. The inflatable figure assembly of claim 1 further comprising an air vent with a plurality of apertures covering said central hole.

9. The inflatable figure assembly of claim 1 further comprising a skirt extending down from said base to said surface.

10. The inflatable figure assembly of claim 1 wherein each of said plurality of lighting bodies further comprises:

fastening tabs with apertures on both sides of said base of said lower cover;

a connecting joint on said base of said upper cover;

a fastening piece with fastening tabs on both side and a top containing a recess;

first and second fasteners securing said fastening piece around a base of said bulb and to said lower cover through the apertures in said fastening tabs;

a third fastener securing said connecting joint of said upper cover in said recess on said fastening piece through the apertures.

* * * * *

UNITED STATES PATENT AND TRADEMARK OFFICE

CERTIFICATE OF CORRECTION

PATENT NO. : 6,644,843 B2
DATED : November 11, 2003
INVENTOR(S) : Tsai Chin-Cheng It is certified that error appears in the above-identified patent and that said Letters Patent is hereby corrected as shown below:

Column 2,
Lines 9 and 10, change "said body" to -- said base --.

Signed and Sealed this

Nineteenth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,644,843 B2
DATED : November 11, 2003
INVENTOR(S) : Tsai Chin-Cheng It is certified that error appears in the above-identified patent and that said Letters Patent is hereby corrected as shown below:

Column 2,
Lines 63 and 64, change "said body" to -- said base --.

This certificate supersedes Certificate of Correction issued April 19, 2005.

Signed and Sealed this

Twenty-fourth Day of May, 2005

JON W. DUDAS
*Director of the United States Patent and Trademark Office*